US006073868A

United States Patent [19]

Stevens et al.

[11] Patent Number: 6,073,868

[45] Date of Patent: Jun. 13, 2000

[54] RE-USABLE YARN WINDING TUBE HAVING REMOVABLE END CAPS

[75] Inventors: James P. Stevens, Castleton; Clint M. Jones, Loudonville; Victor J. DesRosiers, Kinderhook; James E. Johanson, Chatham, all of N.Y.

[73] Assignee: Sonoco Development, Inc., Hartsville, S.C.

[21] Appl. No.: 09/030,046

[22] Filed: Feb. 24, 1998

[51] Int. Cl.[7] ..... B65H 75/12; G09F 3/00

[52] U.S. Cl. ..... 242/118.32; 40/309

[58] Field of Search ..... 242/118.32, 118.31, 242/118.3, 125.1, 609.1, 609.4, 610, 613.5, 912; 40/309

[56] References Cited

U.S. PATENT DOCUMENTS

| | | | |
|---|---|---|---|
| 200,706 | 2/1878 | Fay . | |
| 368,675 | 8/1887 | Leonard . | |
| 379,151 | 3/1888 | Boynton et al. | 242/118.31 |
| 382,091 | 5/1888 | Kelsea | 242/609.1 |
| 411,140 | 9/1889 | Curtis . | |
| 450,730 | 4/1891 | Obenhoff . | |
| 659,306 | 10/1900 | Kingsland . | |
| 866,353 | 9/1907 | Gately . | |
| 1,137,470 | 4/1915 | Elixman . | |
| 1,168,188 | 1/1916 | Gammeter . | |
| 1,222,943 | 4/1917 | Gammeter . | |
| 1,241,193 | 9/1917 | Carlino . | |
| 1,358,531 | 11/1920 | Dodge . | |
| 1,494,440 | 5/1924 | Parker . | |
| 1,560,192 | 11/1925 | Allan . | |
| 1,648,399 | 11/1927 | Hill . | |
| 1,687,586 | 10/1928 | Parker . | |
| 1,929,034 | 10/1933 | Reagles . | |

(List continued on next page.)

FOREIGN PATENT DOCUMENTS

| | | | |
|---|---|---|---|
| 109926 | 3/1940 | Australia . | |
| 1226529 | 7/1960 | France . | |
| 2 459 778 | 1/1981 | France . | |
| 1238302 | 4/1967 | Germany . | |
| 3201745 A1 | 7/1983 | Germany . | |
| 317777 | 2/1935 | Italy . | |
| 61-145087 | 7/1986 | Japan . | |
| 3777 | 2/1895 | United Kingdom . | |
| 12391 | 5/1910 | United Kingdom . | |
| 226683 | 1/1925 | United Kingdom . | |
| 544172 | 3/1942 | United Kingdom | 242/613.5 |
| 630039 | 10/1949 | United Kingdom . | |
| 727992 | 4/1955 | United Kingdom . | |
| 1563692 | 3/1980 | United Kingdom . | |

OTHER PUBLICATIONS

U.S. Statutory Invention Registration No. H1100, Published: Sep. 1, 1992.

*Primary Examiner*—Michael R. Mansen
*Attorney, Agent, or Firm*—Seidel, Gonda, Lavorgna & Monaco, PC

[57] ABSTRACT

A re-usable yarn carrier to be mounted on a winding machine and to have yarn wound on and unwound therefrom is provided. The yarn carrier includes a hollow cylindrical tube which is preferably made of a plastic material. Each end of the tube is provided with a channel. The transition between the outside surface of the tube and the channel is formed by a shoulder. A resilient ring is positioned within each channel. The resilient ring is engaged by the base surface of the channel and forms an engagement surface adjacent to the shoulder on the tube. Further, the end of the ring positioned proximal to the end of the tube forms a protective edge. Thus, if the tube is dropped, the ring takes the brunt of the force rather than the tube material itself. The formation of the ring within the channel within the tube forms a yarn winding engagement surface. In addition, the resilient rings may be provided in various colors and forms so as to provide identification for the type of yarn on the tube.

39 Claims, 6 Drawing Sheets

U.S. PATENT DOCUMENTS

| | | | |
|---|---|---|---|
| 1,997,770 | 4/1935 | Forney et al. . | |
| 2,055,952 | 9/1936 | Summa . | |
| 2,168,465 | 8/1939 | Amrhein . | |
| 2,262,665 | 11/1941 | Cavanaugh | 242/125.1 |
| 2,378,901 | 6/1945 | Amrhein et al. . | |
| 2,381,869 | 8/1945 | Amrhein et al. | 242/118.32 |
| 2,448,242 | 8/1948 | Wilson . | |
| 2,535,188 | 12/1950 | Beckner . | |
| 2,569,094 | 9/1951 | Dunlap . | |
| 2,605,980 | 8/1952 | Atwood et al. . | |
| 2,630,394 | 3/1953 | Atwood . | |
| 2,659,547 | 11/1953 | Broadbent et al. . | |
| 2,674,418 | 4/1954 | Curtis . | |
| 2,757,885 | 8/1956 | Barraclough et al. . | |
| 2,898,054 | 8/1959 | Rea . | |
| 2,953,316 | 9/1960 | Henry . | |
| 2,987,267 | 6/1961 | Hayes et al. . | |
| 3,034,743 | 5/1962 | Hill . | |
| 3,107,067 | 10/1963 | Atwood et al. . | |
| 3,118,633 | 1/1964 | Belville . | |
| 3,138,345 | 6/1964 | Lüber . | |
| 3,284,023 | 11/1966 | Sowell . | |
| 3,285,530 | 11/1966 | Kirshner, Jr. et al. | 242/125.1 |
| 3,326,494 | 6/1967 | Hartley, Jr. . | |
| 3,380,238 | 4/1968 | Araki et al. . | |
| 3,450,370 | 6/1969 | Hawkins | 242/118.32 |
| 3,451,639 | 6/1969 | Atwood et al. . | |
| 3,468,496 | 9/1969 | Limantour . | |
| 3,544,033 | 12/1970 | L'Allemand . | |
| 3,571,878 | 3/1971 | Alderfer . | |
| 3,614,017 | 10/1971 | Julien . | |
| 3,625,451 | 12/1971 | Anderson . | |
| 3,658,275 | 4/1972 | Lahmann | 242/125.1 X |
| 3,717,291 | 2/1973 | Adams et al. . | |
| 3,776,486 | 12/1973 | Blake . | |
| 3,794,260 | 2/1974 | Sowell . | |
| 3,801,038 | 4/1974 | Wust . | |
| 3,820,730 | 6/1974 | Endo et al. . | |
| 3,836,059 | 9/1974 | Lauen et al. . | |
| 3,955,775 | 5/1976 | Egyptien et al. . | |
| 3,986,680 | 10/1976 | Cardell . | |
| 4,018,401 | 4/1977 | Cunningham . | |
| 4,040,572 | 8/1977 | Melan et al. . | |
| 4,049,215 | 9/1977 | Husges . | |
| 4,050,646 | 9/1977 | Burchette, Jr. . | |
| 4,057,201 | 11/1977 | Wilkinson . | |
| 4,063,696 | 12/1977 | Kelly et al. . | |
| 4,101,086 | 7/1978 | Thomas, Jr. . | |
| 4,165,055 | 8/1979 | Dee . | |
| 4,184,653 | 1/1980 | Bonzo . | |
| 4,205,800 | 6/1980 | Melan et al. . | |
| 4,369,933 | 1/1983 | Bedenbaugh . | |
| 4,390,144 | 6/1983 | Mueller . | |
| 4,433,815 | 2/1984 | D'Agnolo . | |
| 4,598,880 | 7/1986 | Brutel et al. . | |
| 4,760,976 | 8/1988 | Burchette, Jr. . | |
| 4,796,830 | 1/1989 | Gelfman . | |
| 4,874,139 | 10/1989 | Kewin . | |
| 4,889,294 | 12/1989 | Adams et al. | 242/118.32 X |
| 4,901,941 | 2/1990 | Powel et al. . | |
| 4,919,359 | 4/1990 | Powel et al. | 242/118.32 X |
| 4,936,523 | 6/1990 | Powel et al. | 242/125.1 |
| 5,211,354 | 5/1993 | Rummage . | |
| 5,328,121 | 7/1994 | Rummage . | |

RE-USABLE YARN WINDING TUBE HAVING REMOVABLE END CAPS

FIELD OF THE INVENTION

The present invention relates generally to a yarn carrier and, in particular, to a yarn winding or draw twist tube for high speed winding operations. The present invention includes a re-usable tube having replaceable protective rings disposed on the ends thereof.

BACKGROUND OF THE INVENTION

During the yarn manufacturing process, yarn packages are formed by winding yarn onto yarn carriers which are rotating at high speeds, sometimes in excess of 8,000 rpms. Typically, a pick up groove is provided at one end of the tube for capturing the yarn and initiating the winding of the yarn on the tube. These yarn winding tubes are often made of paperboard or other fibrous materials such as that disclosed in U.S. Pat. Nos. 1,494,404 and 5,328,121.

The life of a laminated paper yarn tube is somewhat limited. Paper tubes are often damaged during shipment and/or winding of the yarn. Disfiguration of the tube may cause uneven rotation during yarn winding. Moisture absorption by the paper tube may also cause changes in dimension and other physical properties. Furthermore, paper tubes tend to create dust.

Plastic, re-usable winding tubes have been suggested as replacements for paper carriers. Examples of re-usable winding tubes are shown in U.S. Pat. Nos. 4,889,294 and 4,901,941.

One important feature of a yarn winding tube is the means for identification of the particular type of yarn on the tube without detailed inspection of the yarn. A visual symbol or identification mark is often applied to the rim of the tube, above the yarn which has been wound thereon. On paper tubes, these markings may be a printed symbol on the ends of the tube.

However, since the tubes are intended to be reused, an inventory of the marked tubes must be maintained for each particular type of yarn that is processed.

SUMMARY OF THE INVENTION

The present invention relates to a re-usable yarn carrier adapted to have yarn wound thereon and unwound therefrom. The yarn carrier of the present invention includes a hollow cylindrical tube having a substantially cylindrical outer surface. An external annular channel is provided adjoining each end of the tube. The channel includes a base surface which is radially inward of the outer cylindrical surface of the tube. A shoulder is formed between the outer surface of the tube and the channel base surface. The channel is adapted to receive one or more resilient rings which are removably retained within the channel. Preferably the rings bear a marking or are color coded. Thus the placing of the rings on the tubes can serve to identify the type of yarn wound thereon and may be varied as desired. The resilient rings also help protect the ends of the tube from damage.

The rings may include an engagement surface positioned adjacent to the shoulder of the channel on the end of the tube. The engagement surface cooperates with the shoulder to form a startup groove for engaging the yarn while the tube is being rotated. The opposite surface of the ring is positioned adjacent the end of the tube or another resilient ring.

A startup groove for yarn to be wound on the tubular yarn carrier may also be formed within the surface of the tube.

The tube in this embodiment may be formed by first and second cylindrical parts which matingly engage one another and define a groove within the cylindrical outer surface of the tube. Various means may be provided for securing the first and second parts of the tube together.

Further features and advantages of the present invention will become apparent to those skilled in the art upon reviewing the embodiments described below and illustrated in the accompanying drawings.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
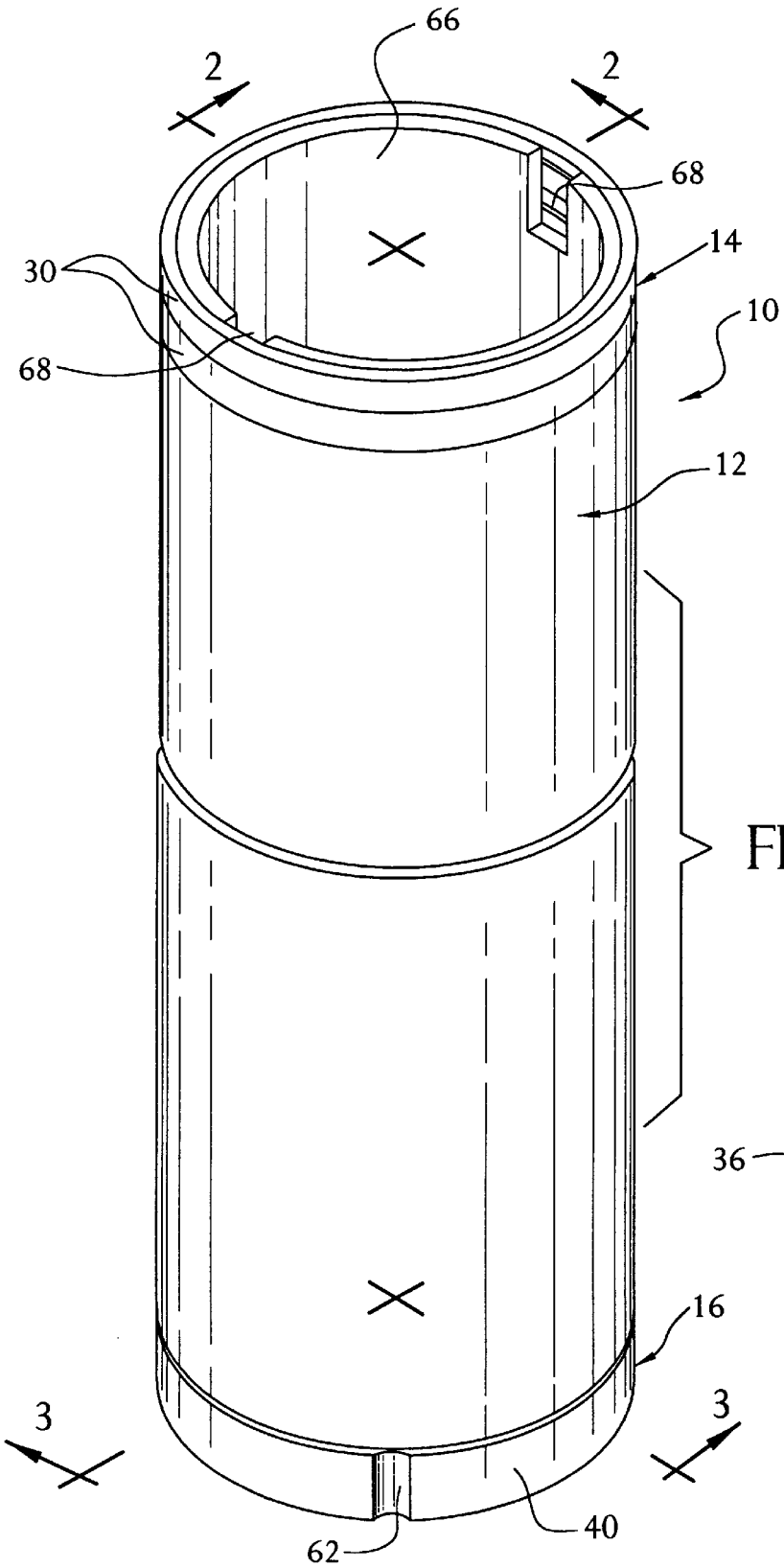
FIG. 1 is a perspective view of a yarn winding tube as contemplated by the present invention.

In the drawings, where like numerals indicate the like elements, there is shown a yarn carrier type tube which is generally designated by the numeral 10. As illustrated in FIG. 1, the carrier 10 is a hollow, elongated tubular body fabricated from plastic or other durable material. Although illustrated as being a cylindrical shape, it should be appreciated that the tubular body could also have a frusto-conical shape or any shape that may be rotated at a high rate of speed. The carrier 10 has an outer surface 12 for receiving yarn to be wound thereon to form a yarn package. A first end 14 and a second end 16 are positioned opposite one another with the outer surface 12 of the tube 10 therebetween.

Figure 2:
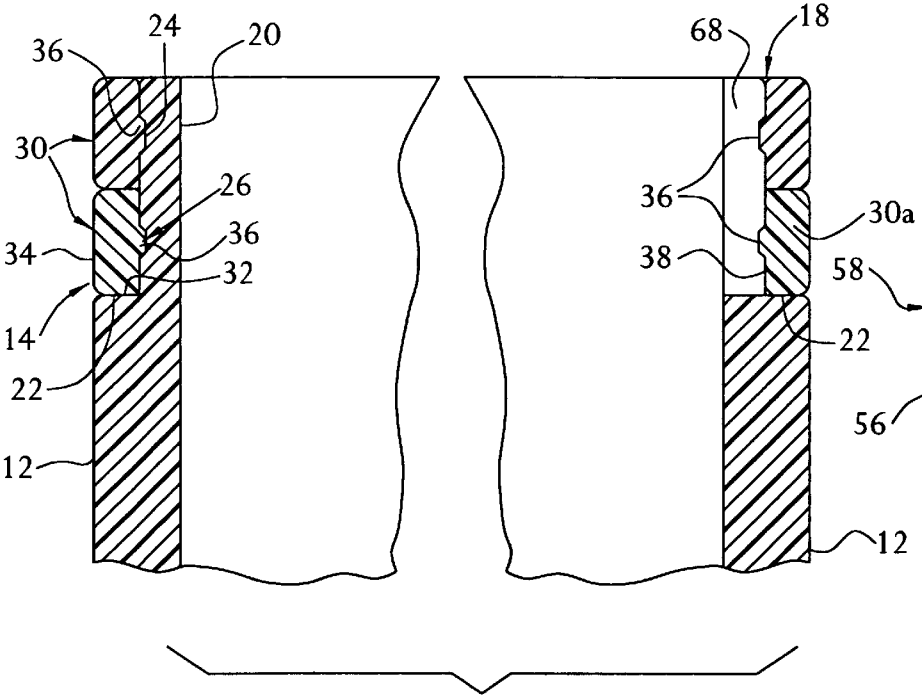
FIG. 2 is a cross-sectional view of an end ring disposed on one end of the tube as taken along line 2—2 in FIG. 1.

As shown in cross-section in FIG. 2, a first external annular channel 18 is formed adjacent the first end 14 of the tube. The first channel 18 has a base surface 20 which is positioned radially inward of the outer surface 12 of the tube. A shoulder 22 extends inwardly from the outer surface 12 to the base surface 20. As illustrated, the shoulder is formed perpendicular to the base surface of the groove. However, the relative angle of the shoulder surface may vary if desired. Parallel annular grooves 24 and 26 are formed in the base surface 20 and extend around the periphery of the channel 18.

Two removable and interchangeable rings 30 are positioned within the first channel 18. The rings are sized so as to substantially overlay the entire base surface 20. The inner ring 30 includes an inner edge or contact surface 32 which is positioned adjacent to the shoulder 22 formed by the channel 18. The outer surface 34 on the rings 30 is shown to be generally planar with the outer surface 12 of the tube. An annular rib 36 is provided on the inside surface 38 of the rings 30. The ribs 36 are positioned within the grooves 24, 26 in the base 20 of the channel 18.

Figure 3:
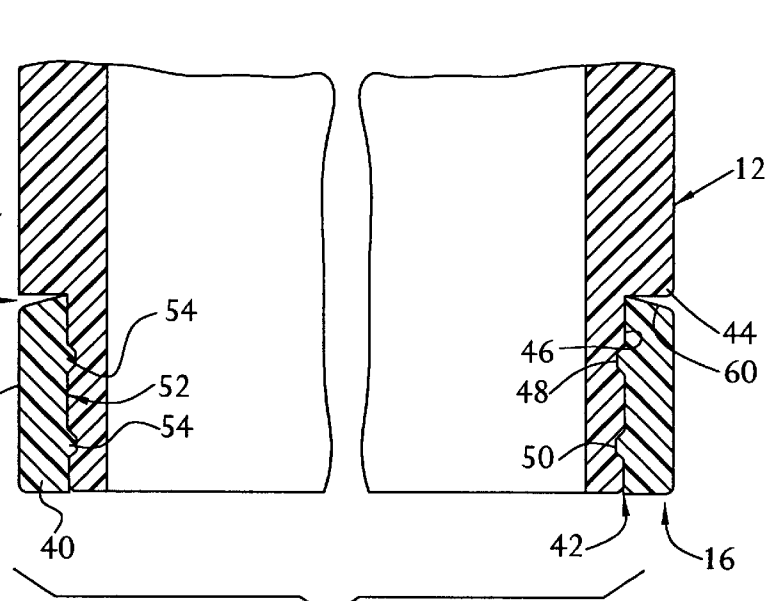
FIG. 3 is a cross-sectional view of an end ring disposed on the opposite end of the tube as taken along line 3—3 in FIG. 1.

As shown in cross-section in FIG. 3, the second end 16 of the tube includes a single ring 40 within a channel 42. For the most part, the channel 42 is identical to channel 18 as found on the first end 14 of the tube. A shoulder 44 is formed at the edge of the channel 42 where the base surface 46 is stepped radially inwardly from the outer surface 12 of the tube. Two grooves 48 and 50 are formed within the base surface 46, These grooves 48, 50 are similar to grooves 24, 26 within the base surface 20 of channel 18 in the first end of the tube. The single ring 40 includes a contact surface 52 having ribs 54 thereon. The ribs 54 are engaged within the grooves 48, 50 to position the single ring 40 in the channel 42. The outer surface 56 of the single ring 40 is substantially planar with the outer surface 12 of the tube. The dimensions of the channel 42 on the second end 16 of the tube are contemplated to be substantially the same as those for the channel 18 within the first end 14 of the tube. The single ring 40 is further contemplated to be twice the height of an individual ring 30. Thus, at either end of the tube 10, a single ring or two individual rings may be provided on the tube.

Figure 4:
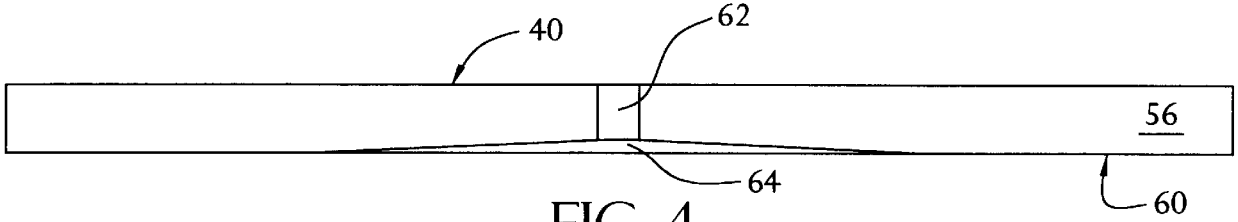
FIG. 4 is a panoramic front elevation of the outer surface of an end ring which is to be attached to the tube.

As illustrated in FIG. 3, a space 58 is formed between the inside edge 60 of the single ring 40 and the shoulder 44. This space 58 defines a slot or groove which may be utilized for starting the winding of yarn (not shown) onto the tube when it is rotated. FIG. 4 illustrates a panoramic of the single ring 40 as if it were stretched linearly rather than being in the form of a circle. An index mark 62 is formed on one edge. The index mark forms an indication for the position of the startup groove 64. The startup groove is formed by tapering the inside surface 60 inwardly, while maintaining the shoulder 44 (FIG. 3) within the channel 42 (or shoulder 22 within channel 18) generally perpendicular to the longitudinal axis of the tube. This tapering of the edge 60 of the ring 40 forms the startup groove 64. The startup groove 64 provides an opening for the yarn and two engagement edges at either end. The engagement edges cause the yarn to be crimped and start winding around the tube as it is rotating. It is contemplated that numerous forms of startup grooves may be utilized between the shoulder and the inside edge of the ring. The variations include the angle of the shoulder around the circumference of the tube and/or the angle of the edge of the ring. Further, it is also possible to vary the length of the groove. The startup groove may be formed between an individual ring, such as ring 30— either between the inside edge 32 of the ring and the shoulder 22 (or shoulder 44)— or between the two rings 30. It is further possible to position the start-up groove at any position inward of the end of the tube.

Figure 5:
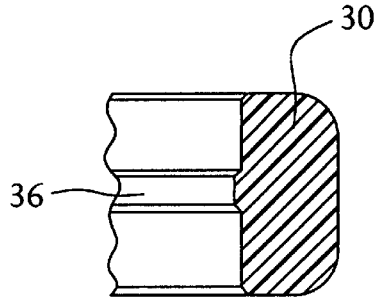
FIG. 5 is a partial cross-sectional view of the end ring shown in FIG. 4.

Returning to FIG. 1, the inside surface 66 of the tube 10 includes slots 68 adjacent the channel 18 on the first end 14 of the tube. Similar slots are incorporated into the channel on the second end 16 of the tube (not shown). The slots provide an engagement surface for a mandrel or the like which will be incorporated into the open end of the tube for causing rotation. In addition, the slots provide an access to the inside surfaces 38 of the rings 30 (or single ring 40) for removal thereof or to provide a visual indication of the color of the rings. As illustrated in the cross section in FIG. 5, the ribs 36 are positioned around the inside surface of the ring 30. As shown in FIG. 2, the ribs 36 extend across the slot 68 when the ring 30 is positioned within the channel 18 (or channel 42).

FIGS. 6–14 illustrate various embodiments of rings which may be incorporated into the general tube structure as contemplated by the present invention.

Figure 6:
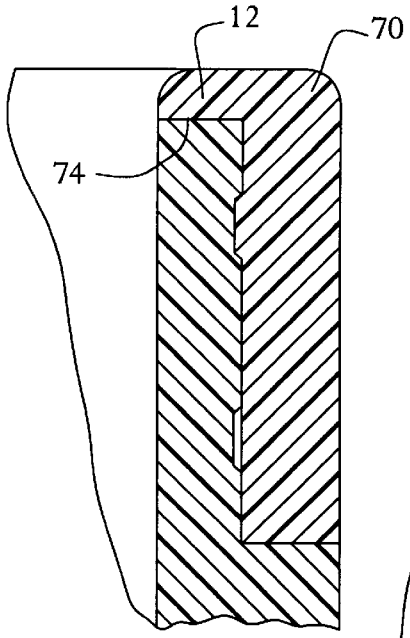
FIG. 6 is a partial cross-sectional view illustrating another embodiment of the present invention.

In FIG. 6, the ring 70 is generally in the form of a single ring and similar to ring 40. Ring 70 includes a top member 72 which projects past and overlaps the edge 74 of the end of the tube. In the embodiment shown in FIGS. 1–5, it is contemplated that the outer edge of the rings will be generally planar with the end edge of the tube.

Figure 7:
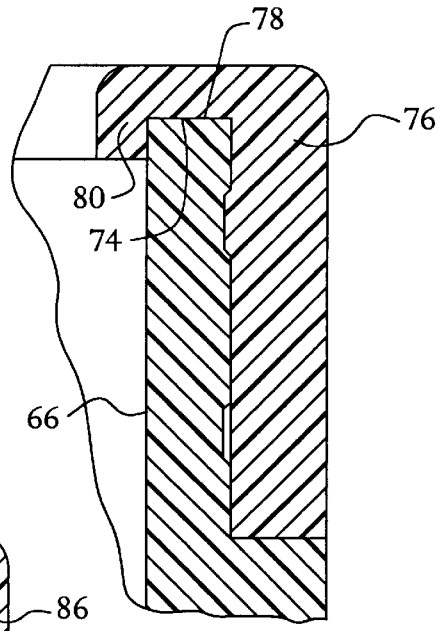
FIG. 7 is a partial cross-sectional view illustrating a further embodiment of the present invention.

In FIG. 7, the ring 76 includes a top member 78 which covers the top edge 74 of the tube. In addition, an overlapping member 80 projects inwardly along the inside surface 66 of the tube.

Figure 8:
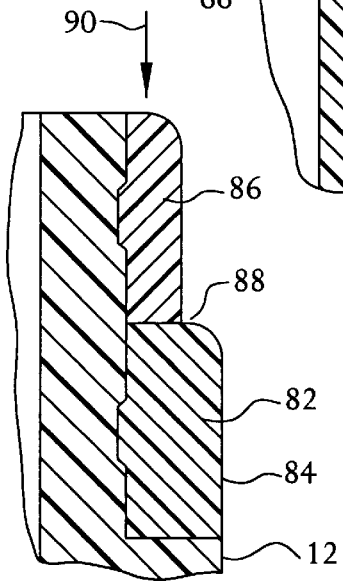
FIG. 8 is a partial cross-sectional view illustrating another alternate embodiment of the present invention.
Figure 9:
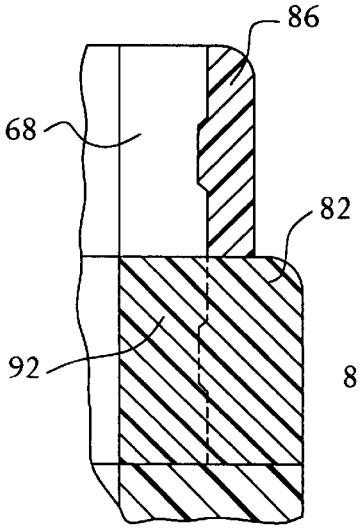
FIG. 9 is a further partial cross-sectional view of the embodiment shown in FIG. 8.
Figure 10:
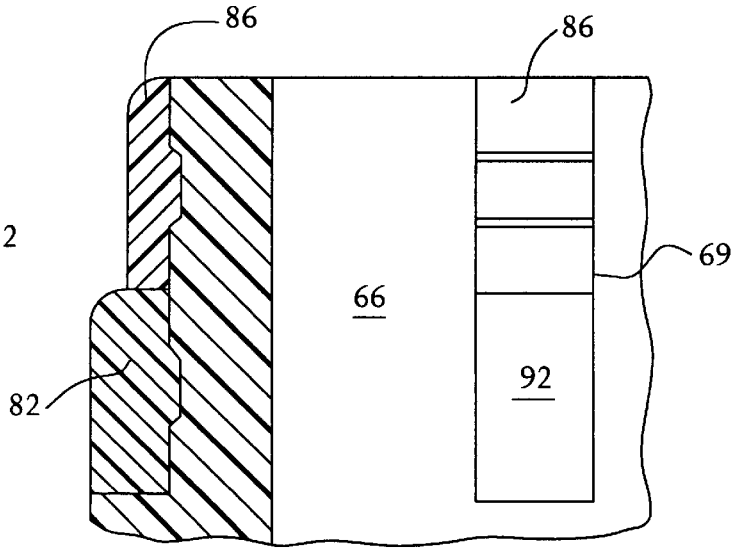
FIG. 10 is a further cross-sectional view illustrating the embodiment of the invention shown in FIG. 8.

In FIGS. 8–10, there is illustrated a stepped ring combination. The inside ring 82 has an outer surface 84 which is generally planar with the outer surface 12 of the tube. The edge ring 86 is not as thick a cross section as the inside ring 82. Thus, there is a step 88 at the juxtaposition of the inside ring 82 and the edge ring 86. When the end of the tube is viewed axially, as shown by arrow 90 in FIG. 8, both the edge ring 86 and the inside ring 82 can be seen. Thus, if the rings are of different color, with the color combination illustrating a particular type of yarn, this identification can be made when viewing the tube axially or when viewing the tube from the side. In FIG. 9, the inside ring 82 is shown to have an inner projection 92 which serves as a key or the like to position the ring 82 on the tube. The key 92 projects into the slot (such as slot 68). This will further assist in visual identification of the color combination between the two rings as well as locking in position the inside ring 82.

FIG. 10 illustrates a similar positioning of the key 92 within the slot 68. The key fills the lower part of the slot 68 and the inner surface of the edge ring 86 is visible through the slot 68 but does not project therein.

Figure 11:
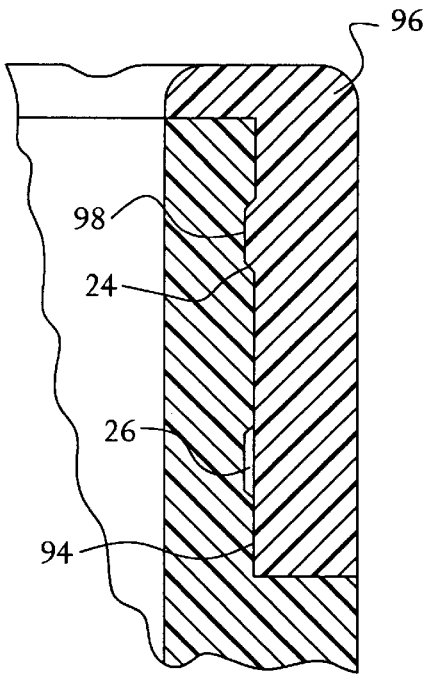
FIG. 11 is a partial cross-sectional view illustrating a still further embodiment of the present invention.

FIG. 11 shows an overlapping ring 96 having a height which fills the channel and a top edge which overlaps the edge of the tube. A single rib 98 is provided on the inside surface 94 of the ring 96. The rib 98 engages groove 24 on the base surface 20 of the channel 18. A second rib is not provided for engagement within the second channel 26.

Figure 12:
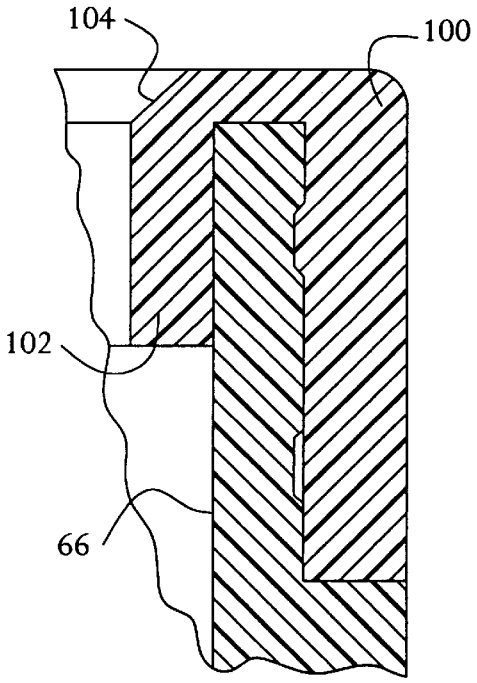
FIG. 12 is a partial cross-sectional view illustrating a further embodiment of the present invention.

In FIG. 12, the overlapping ring 100 includes a downward projection 102 that extends a considerable length into the center of the tube along the inside surface 66. An engagement surface 104 is provided on the inner upper edge of the downward projection 102. The engagement surface 104 may be utilized to engage the mandrel which will rotate the tube during winding and unwinding of the yarn from the tube.

Figure 13:
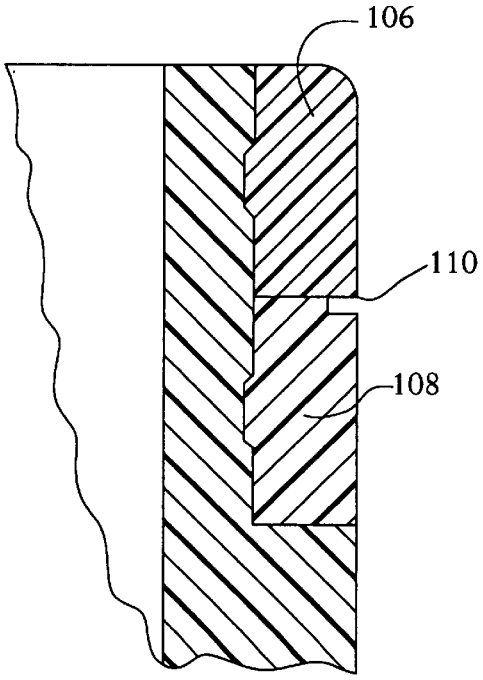
FIG. 13 is a partial cross-sectional view illustrating a still further embodiment of the present invention.

FIG. 13 illustrates a set of rings wherein the outer ring 106 includes a curved outer edge. The inner ring 108 includes a startup groove surface 110. The startup groove is formed at the juxtaposition between the outer ring 106 and the inner ring 108.

Figure 14:
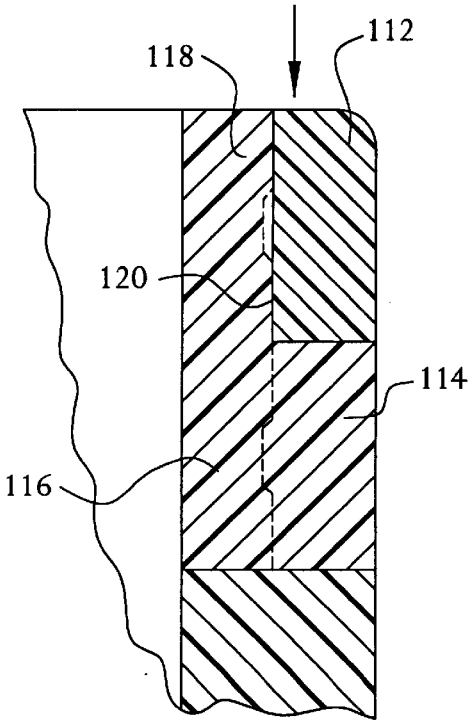
FIG. 14 is a partial cross-sectional view illustrating an additional embodiment of the present invention.

FIG. 14 illustrates a combination of rings 112 and 114. The outer ring 112 is similar to that shown as ring 106 in FIG. 13 having a curved edge adjacent the end of the tube. The inner ring 114 includes an inward projection 116 which is engaged with the slot 68 at the tube end. The inner projection extends along the entire length of the slot and thus terminates adjacent to the tube edge. The terminal end 118 of the projection 116 is positioned adjacent to the inside surface 120 of the outer edge ring 112.

In the preferred embodiment, the tube 10 is 16¾ inches long with the length of the channels at either end being approximately 0.445 inch. The depth of the channel is contemplated to be 0.098 inch with the outer diameter of the tube being 2.453 inches. Preferably, the wall thickness of the tube is 0.185 inches with an inside diameter of 2.083 inches.

The surface of the tube may be textured in to assist in gripping the yarn during winding and to retard slippage of the wound yarn during subsequent handling. The texturing may take the form of a 0.004 pitch spiral groove wherein the threads extend from the base by 0.003 inch and wherein the threads have rounded ends with a 0.001 inch radius. The angle of the threads are contemplated to be approximately 75° with a radial line. Other surface configurations may be utilized and are contemplated.

Preferably, the tubes are injection molded using a polyester resin material. The preferred material is a Hoechst Celanese XCH-800 material. The above identified preferred dimensions have been defined using this preferred material. This combination has been found to provide a substantially straight tube that conforms to the rotational requirements for yarn winding operations. However, other resins and dimensional configurations may be utilized without departing from the essence and features of the present invention.

The rings are preferably made from a copolymer polypropylene. Polypropylene provides good impact strength, is relatively inexpensive and is sufficiently elastic. Thus, the rings may be replaced easily without substantial cost to the user. In addition, the resiliency of the rings provided protection for the ends of the tubes, resisting damage if dropped or during handling, and permits easy assembly, while providing sufficient retention within the channels on the ends of the tube.

Figure 15:
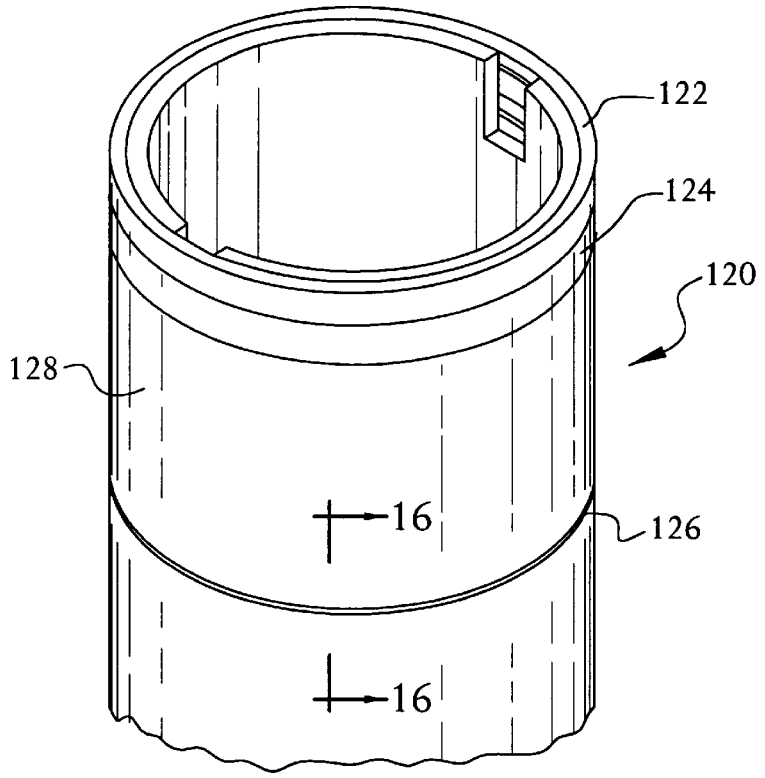
FIG. 15 is a partial perspective view of a further embodiment of the yarn winding tube as contemplated by the present invention.

In FIG. 15, there is shown an alternate embodiment of the yarn winding tube 120. As illustrated, resilient rings 122 and 124 are positioned within a groove at one end of the tube 120. It should be understood that rings may also be provided on the other end of the tube (not shown) and that any form of the rings may be used to provide an identification means for distinguishing the yarn wound on the outer tube surface. This embodiment may also be created without identification rings being positioned at one end or both ends of the tube.

A startup groove 126 is provided within the outer cylindrical surface 128 of the tube 120. Preferably, the startup groove 126 is positioned adjacent, but spaced inwardly from, one end of the tube 120. However, the groove may be positioned at any location along the overall length of the tube. The startup groove 126 is shown in cross section of FIG. 16. The groove 126 is formed by the assembly of two mating parts. The first part 130 receives the male projection of the second part 132. The edges of the first and second parts 130, 132 are drafted so as to be angled with respect to a radial plane. The groove 128 preferably has a depth of approximately 0.070 inches, with the sidewalls of the groove being angled with respect to the radial plane by 10°. Thus, the preferred overall angle of the side walls of the groove is 20°. The angling of the sidewall surfaces of the groove 126 forms a v-shaped notch within the outside cylindrical surface 128 of the tube 120.

The first and second parts 130, 132 may be welded together in any convenient manner. A solvent may be used, such as methyl ethyl ketone (MEK) if the tube 120 is made of an amorphous material. An alternate material would be chosen if the tube were made of polypropylene. Ultrasonic welding may also be utilized. For purposes of ultrasonic welding, energy deflectors may be provided on the angled surface of the male projection of the second part 132. Preferably, the welded seam is formed along this mating surface rather than within the inside surfaces of the groove 126. Other forms of welding may also be utilized, including spin welding.

Figure 16:
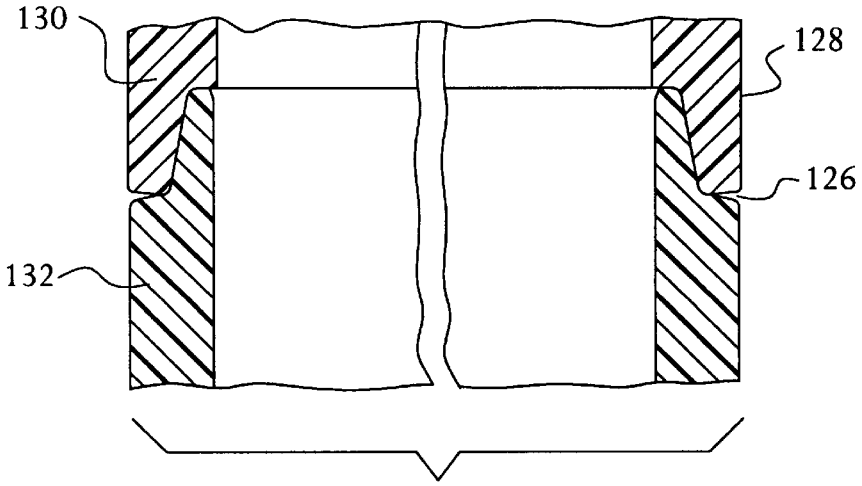
FIG. 16 is a partial cross sectional view of a startup groove formed within the yarn winding tube, the cross section being taken along line 16—16 in FIG. 15.
Figure 17:
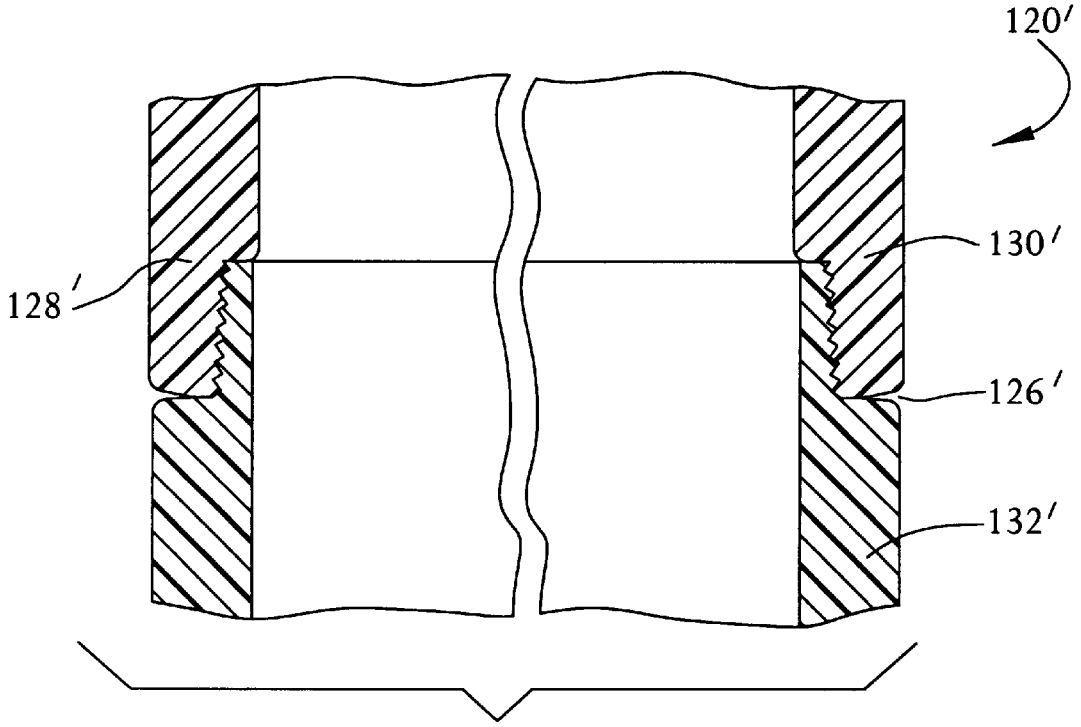
FIG. 17 is a further partial cross sectional view of an embodiment of the yarn winding tube having a startup groove therein.

FIG. 17 shows an alternate embodiment of the tube 120'. In this embodiment, a mechanical interference fit is created between the first part 130' and the second part 132'. The mechanical interference fit is formed by a series of undercuts in the female surface of the first part 130' and a corresponding series of bosses formed on the male projection of the second part 132'. Upon assembly, a groove 126' is formed similar to that shown in FIG. 16. The groove 126' defines a continuous indentation around the outside cylindrical surface 128' of the tube 120'. The mechanical interference fit may take forms other than that specifically illustrated. A welding type operation may also be used to assist the mechanical securing of the first part 130' to the second part 132' in forming the tube 120'.

Formation of a startup groove within a plastic reusable yarn winding tube is difficult as compared to the formation of a groove within a tube made of a fibrous material, such as paperboard. In fibrous materials, a cut is applied to the outside surface of the tube. The fibers from the tube make the groove engage the yarn to be wound thereon and provide the proper startup. In addition, the resiliency of the fibrous material forms a roughened surface on the inside of the groove, further assisting in startup. This roughened, fibrous surface cannot be easily cut into a plastic material. It is also difficult to form a sharp bottom surface as contemplated by the preferred embodiment of the present invention. This sharp V-shaped surface serves to engage the yarn during startup and compensates for the lack of fibrous sidewalls.

In the embodiments shown in FIGS. 15–17, the groove is contemplated to be continuous around the outside cylindrical surface 128, 128' of the tube 120, 120'. However, variations in this startup groove may be utilized and are contemplated. For example, the startup groove may take the form of the groove created by the ring 40 as shown in FIG. 4. Other variations are also possible.

The present invention may be embodied in other specific forms without departing from the spirit or essential attributes thereof and, accordingly, reference should be made to the appended claims, rather than to the foregoing specification, as indicating the scope of the invention.

What is claimed is:

1. A re-usable yarn carrier adapted to be mounted on a winding machine, to have yarn wound thereon and unwound therefrom, and to form a yarn package, said yarn carrier comprising:

a hollow cylindrical tube, the tube having a substantially cylindrical outer surface, a first end and a second end, the first and second ends positioned opposite one another with the outer surface therebetween, a first and second external annular channel adjoining the first and second tube ends, respectively, the first and second channels having a base surface radially inward of the outer surface, and a first and second shoulder formed between the outer surface of the tube and the base surface of the first and second channel, respectively, the first and second shoulders extending inward from the outer surface to the base surface of the corresponding channel;

a first resilient ring removably retained within either the first or second channel, the first ring having an engagement surface positioned adjacent the shoulder when the first ring is retained within the tube channel, the engagement surface cooperating with the tube shoulder to form a groove for engaging the yarn during winding startup, and an end surface adjoining the end of the tube adjacent the channel in which the first ring is retained; and a second resilient ring adapted to be removably retained within the channel in the opposite end of the tube from the first ring, the second ring having an end surface adjoining the end of the tube adjacent the channel in which the second ring is retained, and identification means for distinguishing the yarn to be wound on the outer tube surface.

2. A re-usable yarn carrier as claimed in claim 1, wherein the first and second rings further comprise an extension portion, extending beyond the respective ends of the tube, when the rings are retained within their respective channels.

3. A re-usable yarn carrier as claimed in claim 1, wherein the first and second rings each further comprise an outer ring surface substantially flush with the outer tube surface when the ring is retained within said channel.

4. A re-usable yarn carrier adapted to be mounted on a winding machine, to have yarn wound thereon and unwound therefrom, and to form a yarn package, said yarn carrier comprising:

a hollow cylindrical tube, the tube having a substantially cylindrical outer surface, a first end and a second end, the first and second ends positioned opposite one another with the outer surface therebetween, a first and second external annular channel adjoining the first and second tube ends, respectively, the first and second channels having a base surface radially inward of the outer surface, and a first and second shoulder formed between the outer surface of the tube and the base surface of the first and second channel, respectively, the first and second shoulders extending inward from the outer surface to the base surface of the corresponding channel;

a first resilient ring removably retained within either the first or second channel, the first ring having an engagement surface positioned adjacent the shoulder when the first ring is retained within the tube channel, the engagement surface cooperating with the tube shoulder to form a groove for engaging the yarn during winding startup, and an end surface adjoining the end of the tube adjacent the channel in which the first ring is retained; and identification means for distinguishing the yarn to be wound on the outer tube surface, said identification means comprising a second resilient ring adapted to be removably retained within the channel in the opposite end of the tube from the first ring, the second ring having an end surface adjoining the end of the tube adjacent the channel in which the second ring is retained, and a third resilient ring, the third resilient ring retained within the channel adjacent the second resilient ring.

5. A re-usable yarn carrier as claimed in claim 4, wherein the second and third rings each further comprise an outer ring surface substantially flush with the outer tube surface when the rings are retained within said channel.

6. A re-usable yarn carrier as claimed in claim 4, wherein the second and third rings each further comprise an outer ring surface, the outer ring surface of the second resilient ring being radially inward of the outer ring surface of the third resilient ring.

7. A re-usable yarn carrier as claimed in claim 6, wherein the third resilient ring is positioned between the second resilient ring and the shoulder of the respective channel, the outer ring surface of the third resilient ring being substantially flush with the outer tube surface when retained within the channel, such that both the second and third resilient rings are visible when the tube is viewed from the end thereof upon which the second and third resilient rings are retained.

8. A re-usable yarn carrier adapted to be mounted on a winding machine, to have yarn wound thereon and unwound therefrom, and to form a yarn package, said yarn carrier comprising:

a hollow cylindrical tube, the tube having a substantially cylindrical outer surface, a first end and a second end, the first and second ends positioned opposite one another with the outer surface therebetween, a first and second external annular channel adjoining the first and second tube ends, respectively, the first and second channels having a base surface radially inward of the outer surface, and a first and second shoulder formed between the outer surface of the tube and the base surface of the first and second channel, respectively, the first and second shoulders extending inward from the outer surface to the base surface of the corresponding channel;

a first resilient ring removably retained within either the first or second channel, the first ring having an engagement surface positioned adjacent the shoulder when the first ring is retained within the tube channel, the engagement surface cooperating with the tube shoulder to form a groove for engaging the yarn during winding startup, and an end surface adjoining the end of the tube adjacent the channel in which the first ring is retained; and a second resilient ring adapted to be removably retained within the channel in the opposite end of the tube from the first ring, the second ring having an end surface adjoining the end of the tube adjacent the channel in which the second ring is retained, and forming identification means for distinguishing the yarn to be wound on the outer tube surface, at least one slot extending inwardly of one end of the tube, said at least one slot forming a discontinuity in the channel formed in the said end of the tube surface, the resilient ring retained within the channel being visible from inside the hollow tube.

9. A re-usable yarn carrier as claimed in claim 8, further comprising a third resilient ring, the third resilient ring retained adjacent the second resilient ring within the channel at the end of the tube having the slot therein, the third resilient ring forming further identification means for distinguishing the yarn to be wound on the outer tube surface, and the identification means formed by said second and third resilient rings being visible through the slot from inside the tube.

10. A re-usable yarn carrier as claimed in claim 9, wherein the second and third rings each further comprise an inner ring surface, at least a portion of the inner ring surface of the third resilient ring being radially inward of the inner ring surface of the second resilient ring, the radially inward portion of the inner ring surface of the third resilient ring being positioned within the slot, such that both the second resilient ring and the radially inward portion of the third resilient ring are visible when the tube is viewed from the end thereof upon which the second and third resilient rings are retained.

11. A re-usable yarn carrier adapted to be mounted on a winding machine, to have yarn wound thereon and unwound therefrom, and to form a yarn package, said yarn carrier comprising:

a rigid hollow substantially cylindrical tube, the tube made of a thermoplastic material and having a substantially cylindrical outer surface, a first end and a second end, the first and second ends positioned opposite one another with the outer surface therebetween, a first and second external annular channel adjoining the first and second tube ends, respectively, the first and second channels having a base surface radially inward of the outer surface, and a first and second shoulder formed between the outer surface of the tube and the base surface of the first and second channels, respectively, the first and second shoulders each extending inward from the outer surface to the base surface of the corresponding channel;

a first resilient ring adapted to be removably retained within the first channel; and a second resilient ring, the second ring removably retained within the second channel opposite the first ring, the first and second rings comprising identification means for distinguishing the yarn to be wound on the outer tube surface.

12. A re-usable yarn carrier as claimed in claim 11, wherein the first ring comprises an engagement surface positioned adjacent the first shoulder when the first ring is retained within the first channel, the engagement surface cooperating with the first shoulder to form a groove for engaging yarn during winding startup.

13. A re-usable yarn carrier as claimed in claim 11, wherein the first and second rings are positioned within the first and second channels, respectively, such that they are co-planar with the respective first and second ends of the tube.

14. A re-usable yarn carrier as claimed in claim 13, wherein the first and second rings are made of a resilient material, the rings serving to resist damage to the ends of the rigid tube.

15. A re-usable yarn carrier as claimed in claim 14, wherein the rings are made of polypropylene.

16. A re-usable yarn carrier as claimed in claim 15, wherein the tube is made of polyester.

17. A re-usable yarn carrier as claimed in claim 14, wherein at least one of the first and second rings further comprises an annular top member extending from the channel and overlapping the end of the tube.

18. A re-usable yarn carrier as claimed in claim 17, wherein the top member further comprises an annular projection extending into the center of the hollow tube along its inner diameter.

19. A re-usable yarn carrier adapted to be mounted on a winding machine, to have yarn wound thereon and unwound therefrom, and to form a yarn package, said yarn carrier comprising:

a rigid hollow substantially cylindrical tube, the tube made of a thermoplastic material and having a substantially cylindrical outer surface, a first end and a second end, the first and second ends positioned opposite one another with the outer surface therebetween, a first and second external annular channel adjoining the first and second tube ends, respectively, the first and second channels having a base surface radially inward of the outer surface, and a first and second shoulder formed between the outer surface of the tube and the base surface of the first and second channels, respectively, the first and second shoulders each extending inward from the outer surface to the base surface of the corresponding channel;

a first resilient ring adapted to be removably retained within the first channel, wherein the first ring comprises an engagement surface positioned adjacent the first shoulder when the first ring is retained within the first channel, the engagement surface cooperating with the first shoulder to form a groove for engaging yarn during winding startup;

a second resilient ring, the second ring removably retained within the second channel opposite the first ring; and a third resilient ring removably retained within the second channel adjacent the second ring, the first, second and third rings comprising identification means for distinguishing the yarn to be wound on the outer tube surface.

20. A re-usable yarn carrier as claimed in claim 19, wherein the second ring is positioned within the second channel such that at least a portion of the ring is co-planar with the second end of the tube and the third ring is positioned axially inward from the second end of the tube and is juxtaposed with the shoulder on the second channel.

21. A re-usable yarn carrier as claimed in claim 20, wherein the outer diameter of the third ring is substantially the same as the outer surface of the tube and the outer diameter of the second ring is less that the outer diameter of the third ring.

22. A re-usable yarn carrier adapted to be mounted on a winding machine, to have yarn wound thereon and unwound therefrom, and to form a yarn package, said yarn carrier comprising:

a rigid hollow substantially cylindrical tube, the tube made of a thermoplastic material and having a first cylindrical part and a second cylindrical part, the first and second parts matingly engaging one another to form the tube, a substantially cylindrical outer surface, the engagement between the first and second parts defining a groove within the cylindrical outer surface of the tube, the groove formed for engaging yarn during startup, a first end and a second end, the first and second ends positioned opposite one another with the outer surface therebetween, a first and second external annular channel adjoining the first and second tube ends, respectively, the first and second channels having a base surface radially inward of the outer surface, and a first and second shoulder formed between the outer surface of the tube and the base surface of the first and second channels, respectively, the first and second shoulders each extending inward from the outer surface to the base surface of the corresponding channel;

a first resilient ring adapted to be removably retained within the first channel; and a second resilient ring, the second ring removably retained within the second channel opposite the first ring;

the first and second rings comprising identification means for distinguishing the yarn to be wound on the outer tube surface.

23. A re-usable yarn carrier as claimed in claim 22 wherein the mating engagement between the first and second parts is secured by welding of the two parts together.

24. A re-usable yarn carrier as claimed in claim 23 wherein the welding is solvent welding.

25. A reasonable yarn carrier as claimed in claim 23 wherein the welding is ultrasonic welding.

26. A re-usable yarn carrier as claimed in claim 22 wherein the mating engagement between the first or second parts is formed by a mechanical interference fit between a male portion on the first part and a female portion on the second part.

27. A re-usable thermoplastic yarn winding tube in adapted to be mounted on a winding machine and to have yarn wound thereon and unwound therefrom, and to form a yarn package, said yarn winding tube comprising:

a hollow cylindrical tube formed from a first part and a second part which are positioned along a longitudinal axis, the yarn winding tube forming a substantially cylindrical outer surface, a groove formed in the cylindrical outer surface of said hollow cylindrical tube, the groove formed by the adjacent ends of the first part and second part of said hollow cylindrical tube, the groove having angled sidewalls therein and adapted for engaging yarn during winding startup, said hollow cylindrical tube having two ends, a first end formed on the first part opposite of the engagement of the first part with the second part, and a second end formed on the second part at the opposite end from the engagement of the second part with the first part, the first and second ends positioned opposite one another with the outer cylindrical surface formed therebetween, first and second external annular channels adjoining the first and second ends of the tube, respectively, the first and second channels having a base surface radially inward from the outer surface, a first resilient ring adapted to be removably retained within the first channel, and a second resilient ring adapted to be removably retained within the second channel, the first and second rings forming an identification means for distinguishing the yarn to be wound on the outer tube surface.

28. A re-usable yarn winding tube adapted to be mounted on a winding machine and to have yarn wound thereon and unwound therefrom, and to form a yarn package, said yarn winding tube comprising:

a hollow cylindrical tube formed from a first part and a second part which are positioned along a longitudinal axis, the yarn winding tube forming a substantially cylindrical outer surface, a groove formed in the cylindrical outer surface of said hollow cylindrical tube, the groove formed by the adjacent ends of the first part and second part of said hollow cylindrical tube, the groove having angled sidewalls therein and adapted for engaging yarn dung winding startup, said hollow cylindrical tube having two ends, a first end formed on the first part opposite of the engagement of the first part with the second part, and a second end formed on the second part at the opposite end from the engagement of the second part with the first part, the first and second ends positioned opposite one another with the outer cylindrical surface formed therebetween, at least one external annular channel adjoining a respective one of the first or second ends of the tube, the channel having a base surface inward of the outer surface of the tube, a first resilient ring adapted to be removably retained within the at least one annular channel, and a second resilient ring adapted to be removably retained within the at least one channel, the first and second rings forming an identification means for distinguishing the yarn to be wound on the outer tube surface.

29. A re-usable yarn carrier adapted to be mounted on a winding machine, to have yarn wound thereon and unwound therefrom, and to form a yarn package, said yarn carrier comprising:

a rigid hollow substantially cylindrical tube, the tube made of a thermoplastic material and having a substantially cylindrical outer surface, a first external annular channel formed within the outer surface of the tube, the first channel having a base surface radially inward of the outer surface of the tube, and a shoulder formed between the outer surface of the tube and the base surface of the first channels, the shoulder extending inward from the outer surface to the base surface;

a first resilient ring adapted to be removably retained within the first channel, a second external annular channel formed within the outer surface of the tube, the first channel positioned at one end of the tube and the second channel positioned at the opposite end of the tube, opposite the first channel, the second channel having a base surface radially inward of the outer surface of the tube, and a shoulder formed between the outer surface of the tube and the base surface of the first channel, the shoulder extending inward from the outer surface to the base surface; and a second resilient ring adapted to be removably retained within the second channel, the first and second rings forming identification means for distinguishing the yarn to be wound on the tube.

30. A re-usable yarn carrier adapted to be mounted on a winding machine, to have yam wound thereon and unwound therefrom, and to form a yarn package, said yarn carrier comprising:

a hollow substantially cylindrical tube, the tube having a substantially cylindrical outer surface, a first end and a second end, the first and second ends positioned opposite one another with the outer surface therebetween, an external annular channel adjoining the first tube end, the first channel having a base surface radially inward of the outer surface, and a shoulder formed between the outer surface of the tube and the base surface of the channel, the shoulder extending inward from the outer surface to the base surface of the channel;

a first resilient ring adapted to be removably retained within the channel; and a second resilient ring adapted to be removably retained within the channel adjacent the first ring, the first and second rings comprising identification means for distinguishing the yarn to be wound on the outer tube surface.

31. A re-usable yarn carrier as claimed in claim 30, wherein the second ring comprises an engagement surface positioned adjacent the shoulder when the second ring is retained within the channel, the engagement surface cooperating with the shoulder to form a groove for engaging yarn during winding startup.

32. A re-usable yarn carrier as claimed in claim 30, wherein the first ring is positioned within the channel such that at least a portion of the first ring is co-planar with the first end of the tube and the second ring is positioned axially inward from the first end of the tube and is juxtaposed with the shoulder on the channel.

33. A re-usable yarn carrier as claim 30, wherein the outer diameter of the second ring is substantially the same as the outer surface of the tube and the outer diameter of the first ring is less that the outer diameter of the second ring.

34. A re-usable yarn carrier as claimed in claim 30, wherein the tube further comprises: a second external annular channel formed within the outer surface of the tube, the first channel positioned at one end of the tube and the second channel positioned at the end of the tube opposite the first channel, the second channel having a base surface radially inward of the outer surface of the tube, and a shoulder formed between the outer surface of the tube and the base surface of the first channels, the shoulder extending inward from the outer surface to the base surface; and a third resilient ring adapted to be removably retained within the second channel, the third ring forming a portion of the yam identification means on the tube.

35. A re-usable yam carrier as claimed in claim 30, wherein the tube further comprises: at least one slot extending inwardly of one end of the tube, said at least one slot forming a discontinuity in the channel formed in the first tube end, the first and second resilient rings retained within the channel being visible from inside the hollow tube.

36. A re-usable yarn carrier as claimed in claim 30, wherein at least the first ring is made of a resilient material, the first ring serving to resist damage to the ends of the tube.

37. A re-usable yarn carrier as claimed in claim 35, wherein the first ring further comprises an annular top member extending from the channel and overlapping the end of the tube.

38. A re-usable yarn carrier as claimed in claim 37, wherein the top member further comprises an annular projection extending into the center of the hollow tube along its inner diameter.

39. A re-usable yarn carrier as claimed in claim 30, wherein the hollow tube comprises a first cylindrical part and a second cylindrical part, the first and second parts matingly engaging one another to form the tube, the engagement between the first and second parts defining a groove within the cylindrical outer surface of the tube, the groove formed for engaging yarn during winding startup.

* * * * *